US007650844B2

(12) United States Patent
Eriksson

(10) Patent No.: US 7,650,844 B2
(45) Date of Patent: Jan. 26, 2010

(54) RAILWAY WAGON

(75) Inventor: Jan Eriksson, Nälden (SE)

(73) Assignee: Flexiwaggon AB, Ostersund (SE)

( * ) Notice: Subject to any disclaimer, the term of this patent is extended or adjusted under 35 U.S.C. 154(b) by 241 days.

(21) Appl. No.: 11/663,004

(22) PCT Filed: Sep. 12, 2005

(86) PCT No.: PCT/SE2005/001312

§ 371 (c)(1),
(2), (4) Date: Jun. 15, 2007

(87) PCT Pub. No.: WO2006/031178

PCT Pub. Date: Mar. 23, 2006

(65) Prior Publication Data

US 2008/0271634 A1 Nov. 6, 2008

(30) Foreign Application Priority Data

Sep. 17, 2004 (SE) ..... 0402269

(51) Int. Cl.
*B61D 3/00* (2006.01)

(52) U.S. Cl. ..... 105/355; 105/404

(58) Field of Classification Search ..... 105/355, 105/404; 414/333, 339; 410/1
See application file for complete search history.

(56) References Cited

U.S. PATENT DOCUMENTS 1,968,196 A * 7/1934 Francis ..... 414/333
2,614,857 A * 10/1952 Mathisen ..... 280/8
2,933,053 A * 4/1960 Mellam ..... 410/1
3,019,917 A * 2/1962 Ajero ..... 414/396
3,352,438 A * 11/1967 Davidson ..... 414/333
3,487,437 A * 12/1969 Meskan ..... 180/190
3,504,921 A * 4/1970 Osmond ..... 280/8
3,516,368 A * 6/1970 Wright ..... 105/455
3,581,918 A * 6/1971 Fujioka ..... 414/395
3,884,158 A * 5/1975 Rumell ..... 410/1
3,916,799 A * 11/1975 Smith ..... 410/1
4,129,079 A * 12/1978 Shannon ..... 410/1

(Continued)

FOREIGN PATENT DOCUMENTS

DE 32 34 374 A1 3/1984

(Continued)

*Primary Examiner*—S. Joseph Morano
*Assistant Examiner*—Jason C Smith
(74) *Attorney, Agent, or Firm*—Birch, Stewart, Kolasch & Birch, LLP

(57) ABSTRACT

The present invention relates to a railway wagon comprising a load carrier and front and rear bogies. The load carrier is releasably connected to, and laterally displaceable in relation to, the respective bogies. Supporting devices are mounted at the ends of the load carrier. They support the load carrier when it is displaced in relation to the bogie. Each supporting device comprises an abutment device which is vertically operable between a pulled-up position and an extended position. At each end of the load carrier there is also a displacing driving device for displacing the load carrier relative to the bogie, and a device that counteracts tilting tendencies of the load carrier. Each abutment device comprises a sliding member, which can slide on the base in the extended position. The railway wagon can thus be displaced, for instance pivoted outwards at one end, to allow a truck to be driven on to or off the same.

13 Claims, 8 Drawing Sheets

U.S. PATENT DOCUMENTS

| | | | | |
|---|---|---|---|---|
| 4,167,270 | A * | 9/1979 | LaPlaca | 280/8 |
| 4,776,735 | A * | 10/1988 | Walda et al. | 410/1 |
| 4,780,033 | A * | 10/1988 | Walda et al. | 410/1 |
| 4,880,341 | A * | 11/1989 | Van Den Pol | 410/1 |
| 4,948,310 | A * | 8/1990 | Ord | 410/1 |
| 5,281,072 | A * | 1/1994 | Patouillard et al. | 414/349 |
| 5,341,746 | A * | 8/1994 | Theurer et al. | 105/355 |
| 5,911,422 | A * | 6/1999 | Carpenter et al. | 280/8 |
| 6,279,483 | B1 * | 8/2001 | Murray et al. | 104/29 |
| 2002/0029720 | A1 * | 3/2002 | Esposito et al. | 105/329.1 |
| 2007/0025831 | A1 * | 2/2007 | Burt et al. | 414/339 |
| 2008/0271634 | A1 * | 11/2008 | Eriksson | 105/355 |

FOREIGN PATENT DOCUMENTS

| | | | |
|---|---|---|---|
| EP | 0 404 037 | A2 | 12/1990 |
| EP | 0 622 284 | A1 | 11/1994 |
| EP | 0 768 226 | A2 | 4/1997 |
| SE | 503 925 | C2 | 9/1996 |
| SU | 233347 | | 3/1967 |
| SU | 870235 | | 1/1980 |
| WO | WO-81/02142 | A1 | 8/1981 |
| WO | WO-96/11829 | | 4/1996 |
| WO | WO-2004/022403 | A1 | 3/2004 |

* cited by examiner

RAILWAY WAGON

FIELD OF THE INVENTION

The present invention relates to a railway wagon comprising a load carrier and front and rear bogies, the load carrier having front and rear ends, at which the load carrier is releasably connected to the respective bogies, the load carrier being at each end laterally displaceable in relation to the bogie, and the load carrier being provided at each end with a supporting device, which supports the end of the load carrier in a position where it is displaced in relation to the bogie.

BACKGROUND ART

A previously known railway wagon having the features defined by way of introduction is disclosed in the publication WO 96/11829.

When the load carrier is released from the bogie at one or both ends to be displaced to a loading and unloading position, a supporting device is driven down right between the railway rails to abut against the base. The supporting device comprises a driving wheel, which performs the displacement, and two supporting wheels, which give improved stability to the load carrier during the displacement. For the rails not to be in the way, a concrete platform is arranged between and beside the rails. The upper side of the platform is flush with the upper sides of the rails. A problem with this construction of the supporting device is that it requires a solid and substantially flat base in order to function in a satisfactory manner. Therefore, the above-mentioned, specially built concrete platforms are necessary, on which the supporting device can roll.

It is conceivable that a variant according to WO 96/11829 with four wheels, on which a drive transport band of reinforced rubber runs, could have a wider use, but this is uncertain. Moreover such a construction is relatively complex.

Furthermore EP 0622284 discloses a railway wagon having a load carrier which in turn rests on a subjacent frame structure. The frame structure extends between the bogies and is at its ends fixedly connected to the same. The load carrier is turned about a centre and has on its underside supporting wheels which rest on curved beams of the frame structure. During turning, the wheels roll on these beams. The load carrier is at both ends provided with a rotating supporting wheel on each side which can be lowered in connection with loading and unloading to provide extra safety in the form of protection against tilting. The positioning of the supporting wheels on the sides has the advantage that the above-mentioned special concrete platform is not required. Drawbacks of this railway wagon are on the other hand that the construction only works for turning the load carrier about a centre, that the frame structure is extended in the vertical direction so that the load carrier will be positioned at an undesirably high level above the ground, and that the base must be flat and solid.

SUMMARY OF THE INVENTION

The object of the invention is to provide a railway wagon of the type mentioned by way of introduction, whose supporting device can be used also without special arrangements like the above-mentioned concrete platforms and which can be used with fairly soft and/or uneven bases.

The object is achieved by a railway wagon according to the invention.

In one aspect of the invention, a railway wagon is thus provided, which comprises a load carrier and front and rear bogies, the load carrier being releasably connected to the respective bogies, and laterally displaceable in relation to each bogie. The load carrier has a front and a rear end and is at each end provided with a supporting device. The respective supporting devices support the load carrier in a position where it is displaced relative to the bogie and each comprise an abutment device which is vertically operable between a pulled-up position and an extended. In the extended position, the abutment device abuts against a base, usually the ground. The railway wagon further has, at each end of the load carrier, a displacing driving device for displacing the load carrier relative to the bogie, at least along an initial displacement distance, and a tilt-preventing device, which is adapted to counteract, at least during part of the displacement, tilting tendencies of the load carrier. Each abutment device comprises a sliding member, which is adapted to abut against the base in the extended position.

The combination of the displacing, tilt-preventing and supporting devices results in a wide range of application. Thus, it is for instance possible first to displace the load carrier a distance and then drive the abutment device of the supporting device down to abut against the ground by the side of a rail. During the first movement, which is driven by the displacing device, and/or later during the displacement, the tilt-preventing device counteracts any tilting tendencies of the load carrier. With the abutment device driven down, the load carrier can, in a very reliable manner, be further displaced to the position where loading/unloading is to occur. If the ground is relatively soft, the sliding member ensures that the abutment device slides on top or in any case at such a high level that a continued displacement is allowed. Of course, there is a dependence on the location of the abutment device seen in the lateral direction of the load carrier and a relationship between that location and how great initial displacement can be performed. However, it is easy to understand that the means defined in the claim are sufficient to carry out such a solution.

In one embodiment of the railway wagon according to the invention, each abutment device further comprises a supporting wheel, a portion of the supporting wheel at least in the extended position extending below an underside of the sliding member. In another embodiment, the supporting wheel is adjustable so that in said extended position it can also be located in a position where it does not extend below the underside of the sliding member. The combination of supporting wheel and sliding member is advantageous since the friction against the base is minimised for all types of base. If the base is hard and the supporting wheel extends below the underside of the sliding member, it will roll on the base while the sliding member is freely suspended. If, however, the base is so soft that the supporting wheel sinks down, the sliding member takes up some of, or the entire, load and slides on the base. This means that the friction will be reduced, compared with a wheel digging itself deep down into the base. With varying bases, the embodiment with the adjustable supporting wheel has the advantage that it is possible to choose whether the supporting wheel is to be used or not. As will be evident from additional embodiments, it is within the scope of the invention to use a plurality of sliding members and/or a plurality of supporting wheels in various configurations to achieve optimum applicability. Moreover, as is also defined in one embodiment, the sliding member is advantageously ski-shaped, in which case its end curving upwards allows it to manage soft bases even better. Since an idea of the invention is that it should be possible to lower the abutment device by the side of, that is outside, the rails of the railway track, it may be advantageous to limit the extent of the supporting device in the lateral direction of the load carrier. This is achieved by making the sliding member as short as possible and, respectively, in the combination with a supporting wheel, by making the wheel as small as possible. At the same time the diameter of the supporting wheel must have a certain minimum size in order to maintain good rollability on in any case semi-soft bases. Advantageous examples of practical implementations will be described below.

In an embodiment of the railway wagon according to the invention, the sliding member is formed with an opening to be passed by said portion of the supporting wheel. This embodiment has the advantage that the supporting wheel and the sliding member use a common surface of the base. Moreover there is no risk that so much material is built up in front of the wheel as to prevent it from rolling on.

In one embodiment of the railway wagon according to the invention, the operating device and the supporting device as a unit are attached to a lateral beam of the load carrier. This embodiment provides a sufficiently lateral arrangement of the supporting device, and thus of the abutment device, and in addition the supporting device can be made compact. In another embodiment, the supporting device instead comprises an operating arm to one end of which the operating device is connected, for operation of the same, and whose other end is rotatably mounted in a fastening portion of the load carrier. The operating arm has an extent in the lateral direction of the load carrier and the abutment device is connected to the operating arm between the ends thereof. This embodiment results in a lower load on the operating device owing to leverage by means of the operating arm.

In an embodiment of the railway wagon according to the invention, the load carrier has lateral beams, which are arranged on opposite sides of the load carrier, and each tilt-preventing device comprises a crossbar which extends between the lateral beams at the ends thereof. The crossbar is movably and releasably connected to the bogie via a connecting portion, the crossbar being adapted to rest against the connecting portion at least along the initial displacement distance. This is a simple and robust construction which eliminates the risk of the load carrier tilting when its one end begins to be displaced, or both ends begin to be displaced, relative to the associated bogie and one lateral beam of the load carrier is positioned outside the lateral edge of the bogie.

Additional objects and advantages of the invention will be discussed below by way of exemplary embodiments.

BRIEF DESCRIPTION OF THE DRAWINGS

Exemplary embodiments of the invention will be described below with reference to the accompanying drawings, in which.

DESCRIPTION OF EMBODIMENTS

Figure 1:
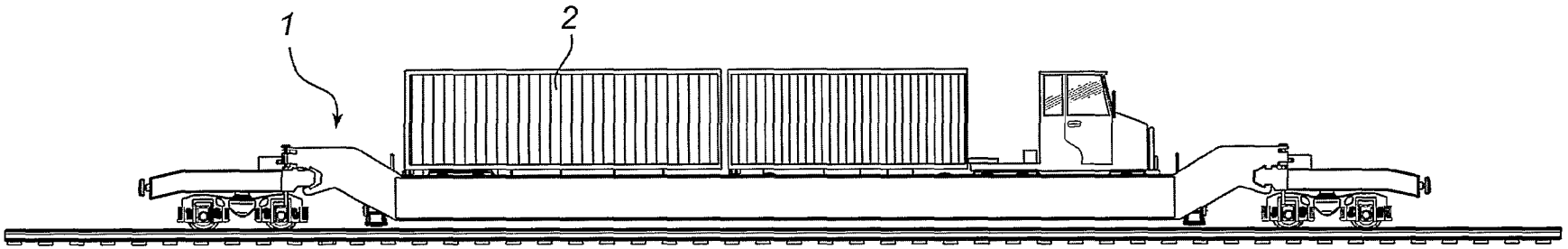
FIGS. 1 and 2 are a schematic side view and respectively a schematic perspective view of a railway wagon according to the invention with a truck loaded thereon.
Figure 2:
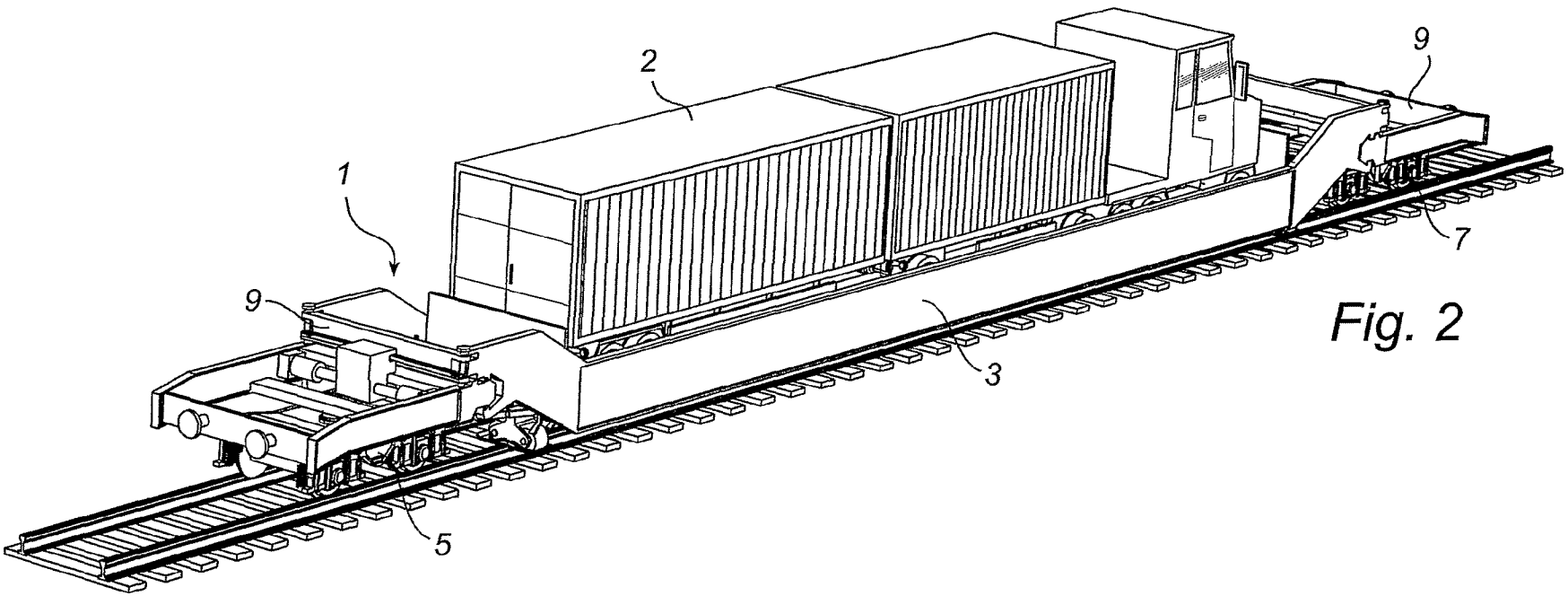
Figure 3A:
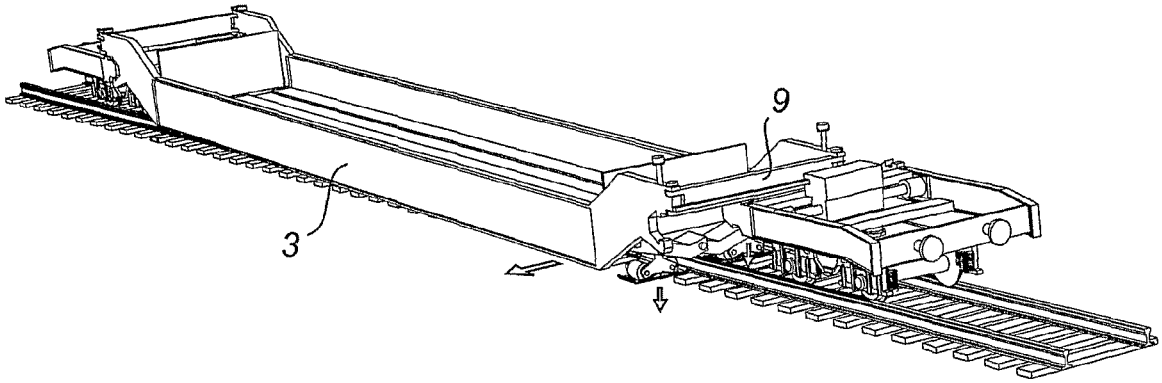
FIGS. 3*a*-3*d* are schematic perspective views illustrating a loading process.
Figure 3B:
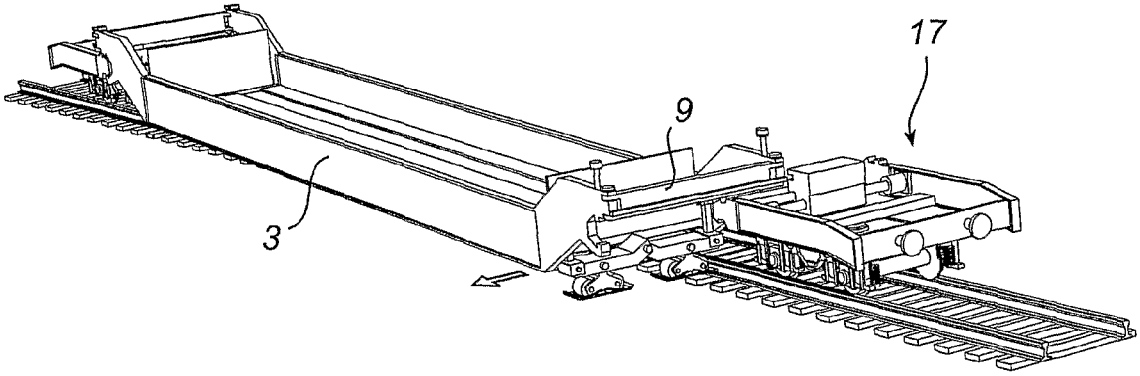
Figure 3C:
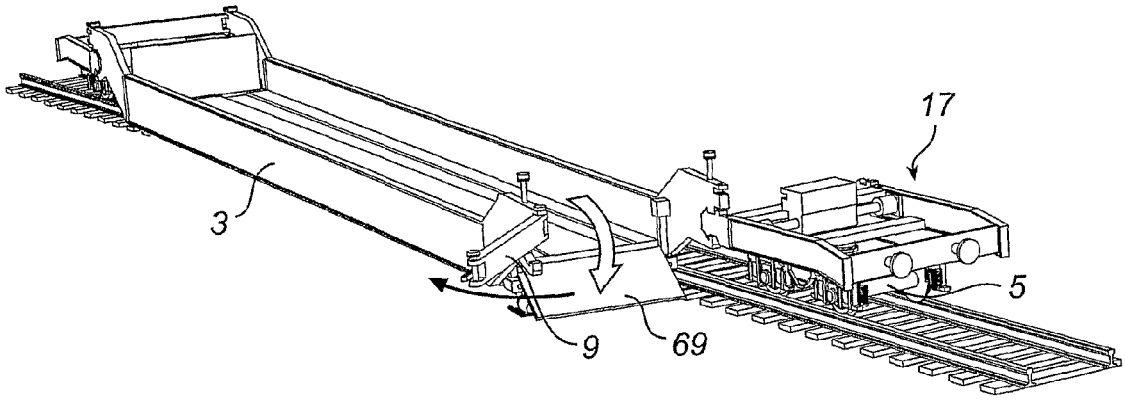
Figure 3D:
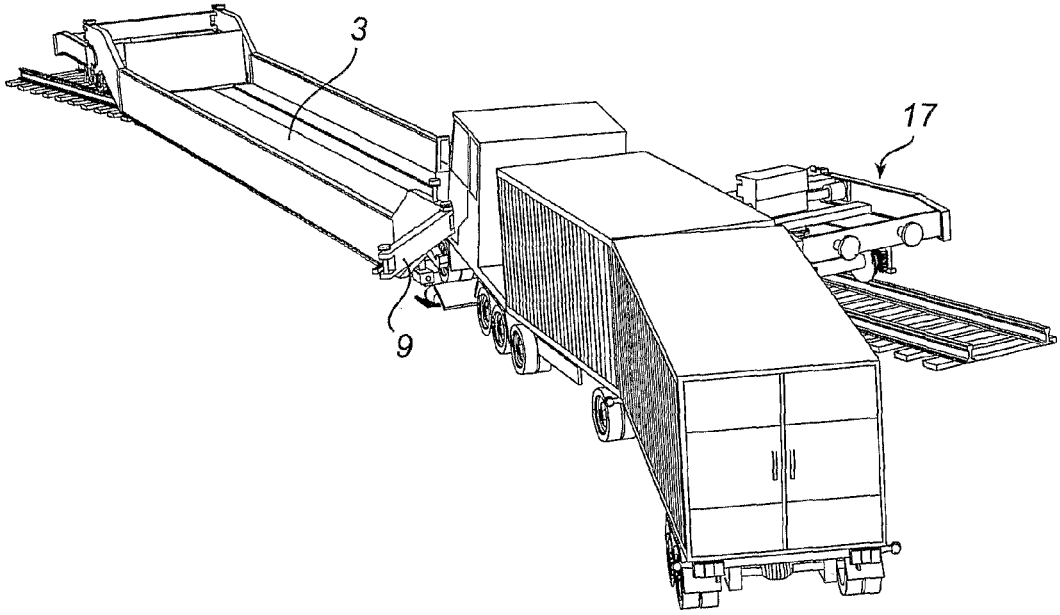
Figure 14:
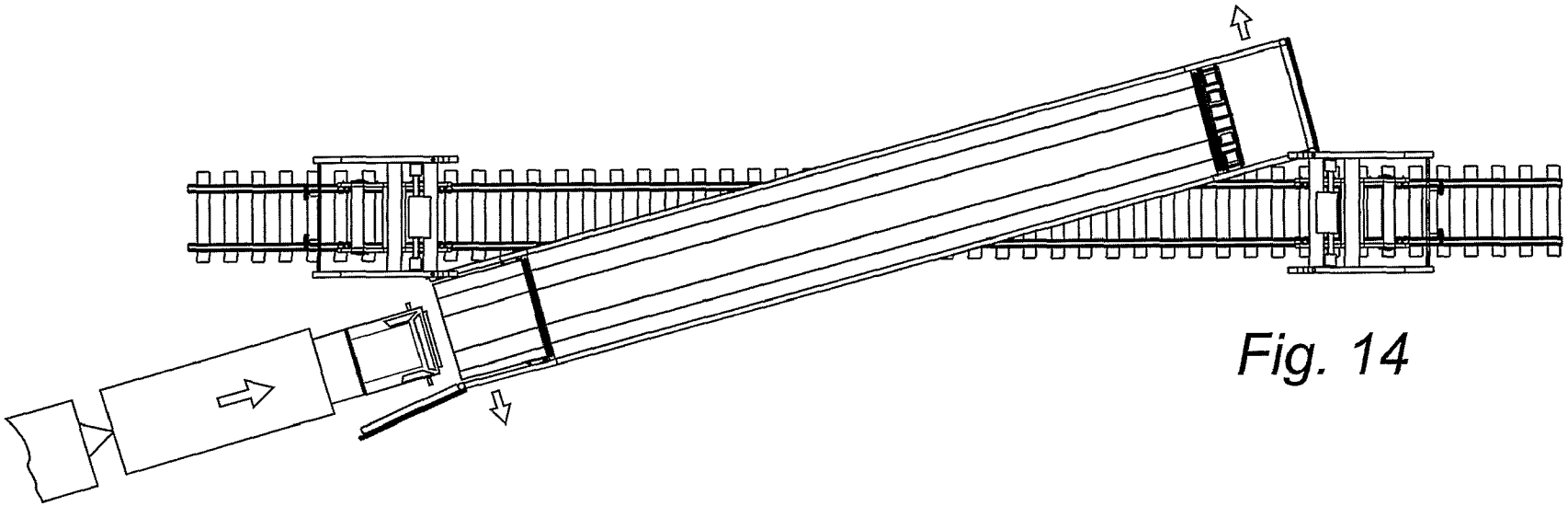
FIGS. 14-15 are schematic top plan views of different loading/unloading positions.
Figure 15:
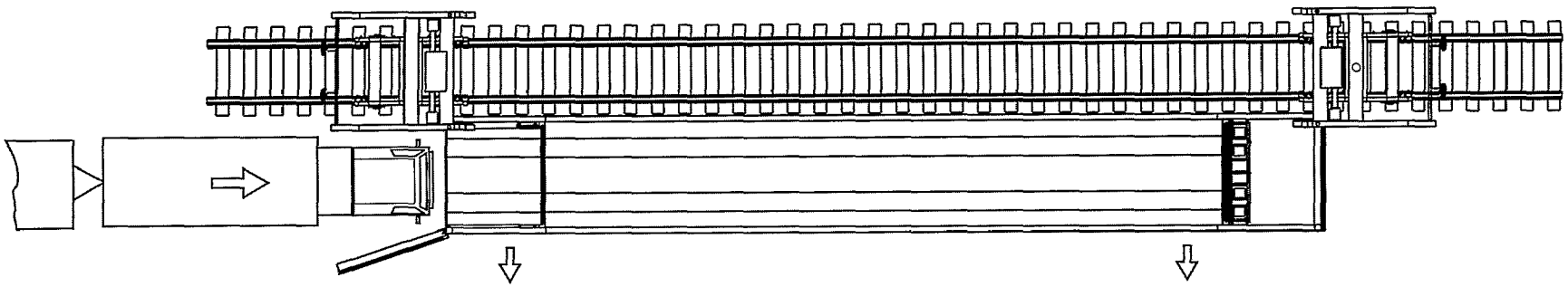

The invention concerns a railway wagon which is designed for the modern concept of loading and unloading of entire vehicles. FIGS. 1 and 2 illustrate precisely a railway wagon 1 which carries a truck 2. FIG. 2 shows the principle of construction which enables the concept. The railway wagon comprises a load carrier 3, which is releasably connected to front and rear bogies 5, 7. When loading of a vehicle, for instance a truck, is to occur, one/the front end of the load carrier 3 is released and displaced, in this case by being pivoted on a pivot which is positioned at its other/rear end, relative to the bogie 3. A crossbar 9, which is included in a tilt-preventing device which will be described in more detail below, is released at its one end and pivoted away. Then the vehicle can drive up on the load carrier 3, after which the load carrier is returned to the initial position and locked. FIG. 14 shows that the other end of the load carrier 3 can also be pivoted outwards in a corresponding manner. FIG. 15 illustrates another alternative loading and unloading position, where both ends of the load carrier 3 have been displaced to the same side so that the load carrier is positioned beside the bogies parallel to the railway track.

Figure 4:
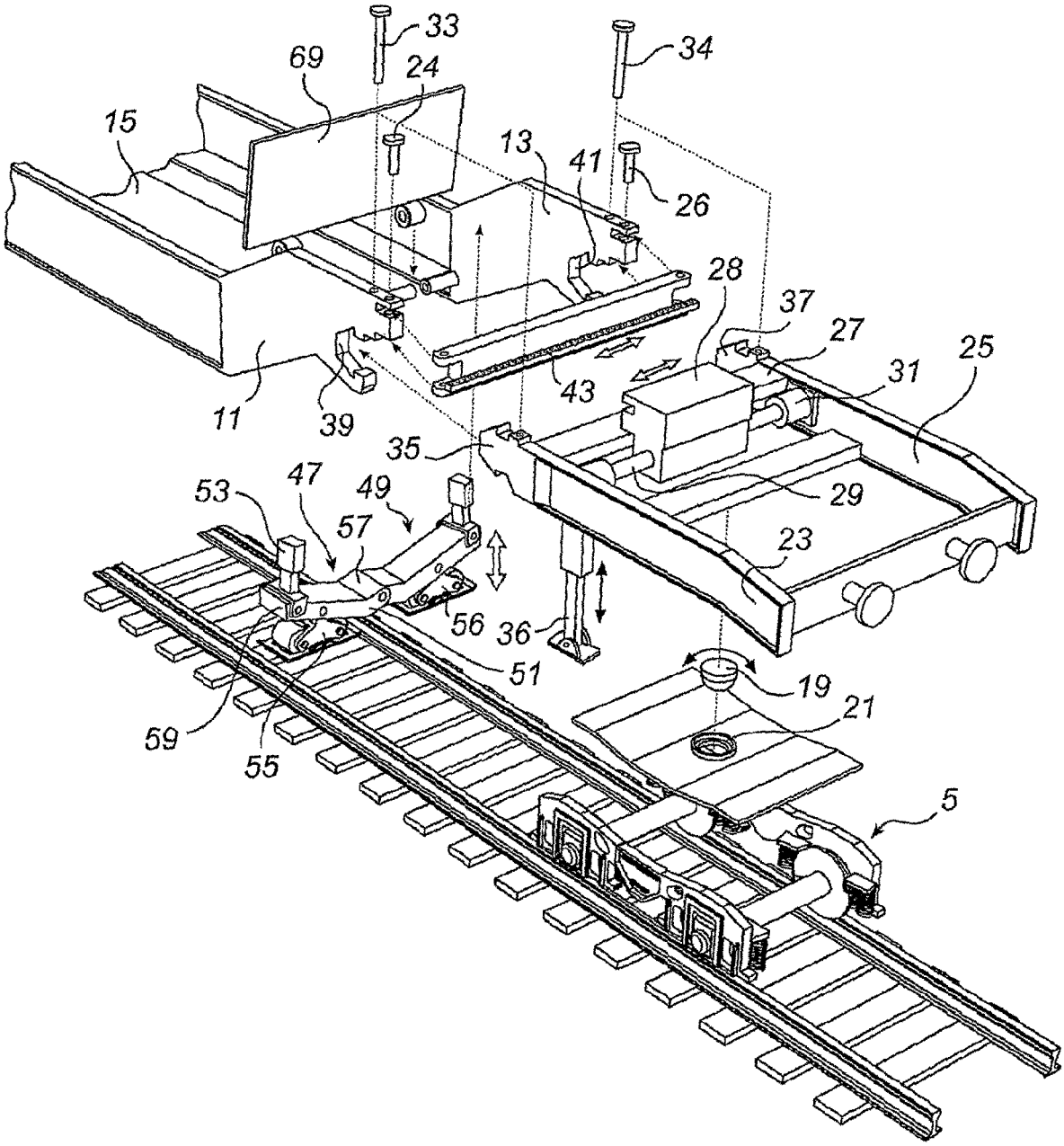
FIG. 4 is an exploded view which schematically illustrates an end of an embodiment of the railway wagon according to the invention.

As shown in FIG. 4, the load carrier 3 has two spaced-apart opposite lateral beams 11, 13 and a bottom part, or platform part, 15 extending between them. The bottom part 15 constitutes the actual loading surface on which the vehicle 2 is received. To enable safe displacement of the load carrier 3 in relation to the respective bogies 5, 7, the railway wagon 1 is equipped in the following way. It should first be emphasised that both ends of the railway wagon 1 preferably, and in any case in this embodiment, are identically constructed. Therefore only one end will be considered. At the bottom, there is the bogie 5 in contact with the rails via the wheels. An intermediate part 17 is arranged on top of the bogie. The intermediate part 17 is pivotally connected to the bogie by means of a pivot projection 19 which is lowered into a seat 21 in the bogie. The intermediate part is provided with connecting means (not shown) for connecting the wagon 1 to another wagon or an engine in a generally known manner. The intermediate part 17 is further provided with frame side members 23, 25 between which extends a guideway 27. Parallel to the guideway, a displacing driving device extends, comprising a feeder 28, which is supported by two cooperating piston-and-cylinder assemblies 29, 31. The load carrier has a crossbar 9 (see also FIG. 3), which extends between the ends of the lateral beams 11, 13 and is releasably and hingedly connected to the same. In a transport position, when the wagon 1 is to be run on the rail, the load carrier 3 is connected to the intermediate part 17, connecting projections 35, 37 in the ends of the frame side members 23, 25 being in engagement with corresponding connecting recesses 39, 41 in the ends of the lateral beams 11, 13. At the same time the crossbar 9 extends parallel to the guideway 27 and rests on the same, or is arranged with a small clearance to the same. First locking means 33, 34 lock the lateral beams 11, 13 in relation to the frame side members 23, and second locking means 24, 26 lock the crossbar 9 to the lateral beams. The locking beams can be, for instance, hydraulically controlled and are greatly simplified in the Figure. A portion of a feeding beam 43, which is an elongate projecting portion of the crossbar 9, extending along the crossbar 9, is inserted into a recess 45 in the feeder 28.

Two supporting devices 47, 49 are arranged at the end of the load carrier 3. The supporting devices are identical but mirror-inverted. Only one of them will therefore be described in more detail. The supporting device 47 comprises an operating arm 51, an operating device 53 and an abutment device 55. The operating device 53 is mounted on the inside of the lateral beam 11. One end 57 of the operating arm 51 is hingedly connected to the front end of the bottom part 15 in the centre of the bottom part 15 and its other end 59 is hingedly connected to the operating device 53. The abutment device 55 is mounted on the operating arm 51 between its ends 57, 59.

Figure 5:
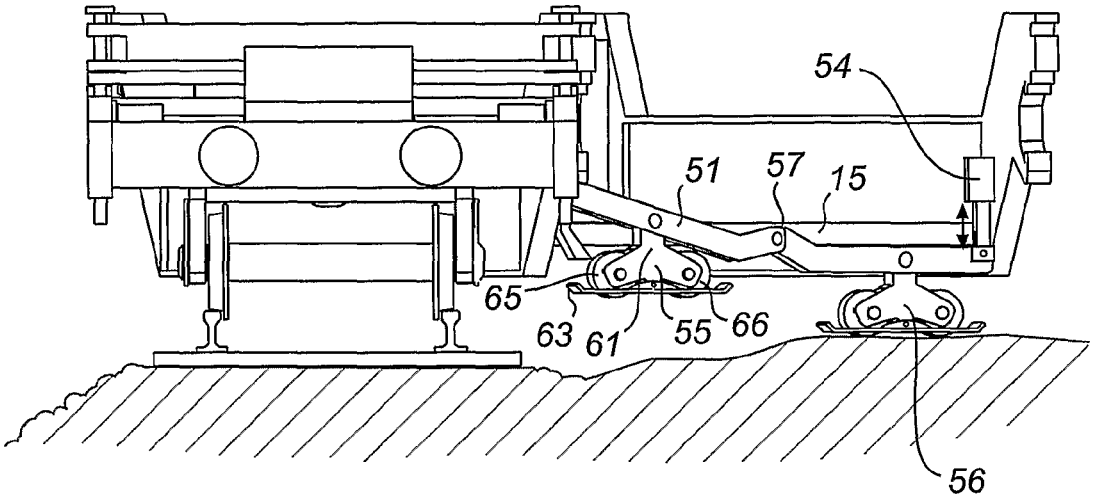
FIGS. 5-8 are schematic perspective views illustrating different embodiments of supporting devices included in the railway wagon according to the invention.
Figure 9A:
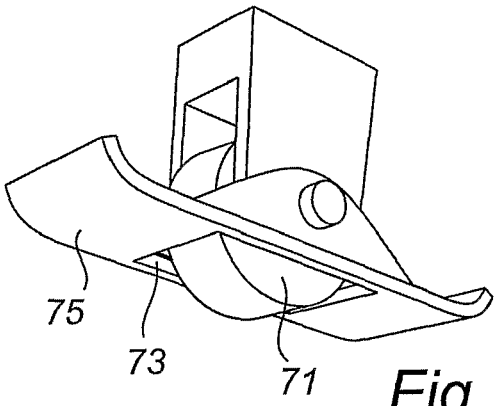
FIGS. 9*a*, 9*b*, 10-13 are schematic perspective views illustrating different embodiments of abutment devices according to the invention.
Figure 10:
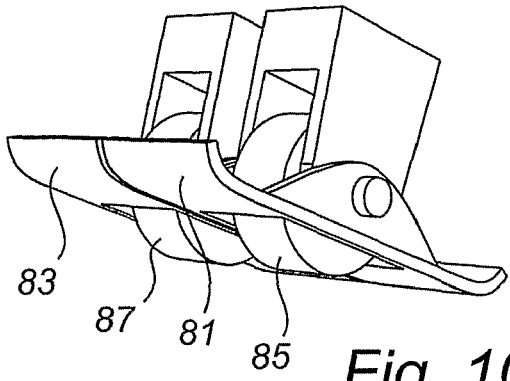
Figure 9B:
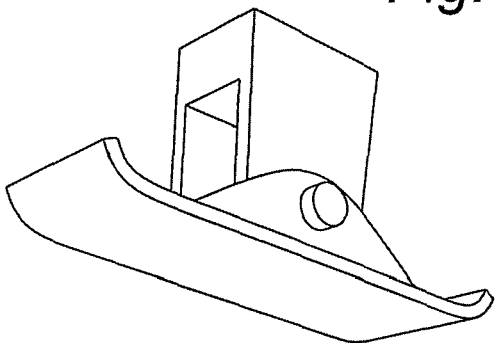
Figure 11:
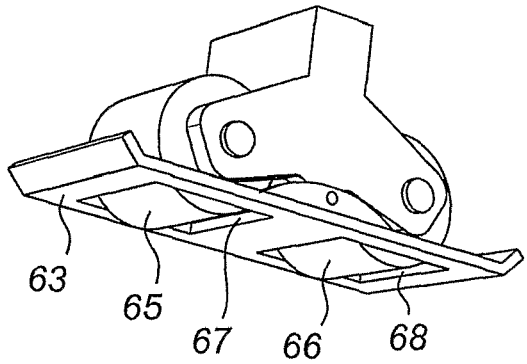
Figure 12:
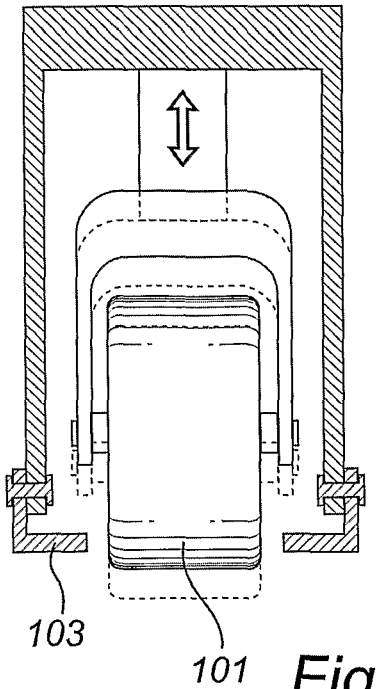
Figure 13:
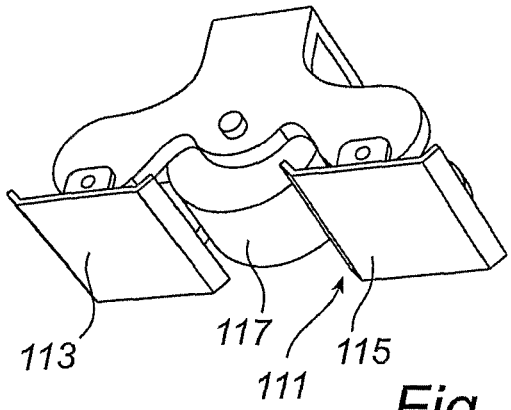

As is best seen in FIG. 5, the abutment device 55 comprises a support 61, whose one end is connected to the operating arm 51 and whose other end constitutes an attachment for a sliding member 63 which is ski-shaped, and two supporting wheels 65, 66. The sliding member 63 is hingedly connected to the support 61 and the supporting wheels 65, 66 are rotatably connected to the support 61. The sliding member 63 is formed with two openings 67, 68. The supporting wheels 65, 66 project a distance through the respective openings, see also for instance FIG. 9*a*. The supporting wheels 65, 66 thus extend below the underside of the sliding member 63. The supporting wheels 65, 66 project to such an extent as to abut against a base, if this is hard or fairly hard, while the sliding member 63 substantially does not abut against the base. At the same time the supporting wheels 65, 66 do not project to such an extent as to constitute a considerable brake on soft bases, where the supporting wheels 65, 66 sink into the base and the sliding member 63 comes into abutment against the base.

The operating device 53 is a piston-and-cylinder assembly which is adapted to lower and raise the outer end 59 of the operating arm 51 and thereby rotate the same about the other end 57. As a result, the abutment device 55 is vertically displaced.

Figure 7:
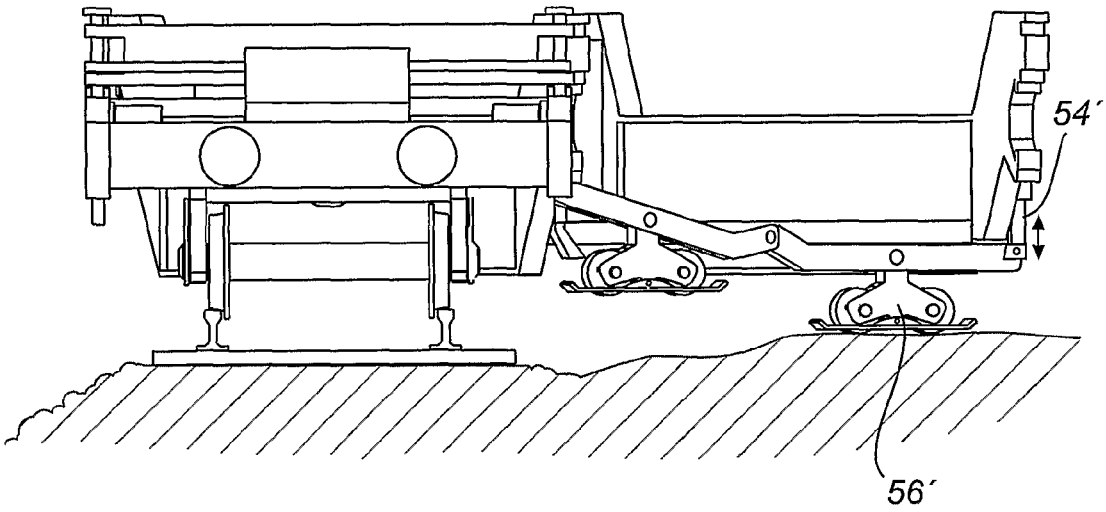

FIG. 7 illustrates schematically an alternative embodiment where the operating devices 54' are arranged on the outside of the lateral beams.

The displacement of the load carrier 3 in relation to the bogie 5 from the transport position to the position for loading and unloading is performed in the following manner. First the locking means 33, 34 are released so that the load carrier 3 is movable in relation to the intermediate part 17. Subsequently the end of the load carrier 3 is driven out a distance by the feeder 28 being moved in the lateral direction by means of the piston-and-cylinder assemblies 29, 31. The feeder 28 is, by means of one or more engaging pins which are inserted into holes in the feeding beam 43, in engagement with the feeding beam 43 on the crossbar 9 and pulls the same along in its movement. Once the end of the load carrier 3 has been displaced, in this embodiment has been pivoted outwards, so far that the abutment device is positioned outside the rail, the abutment device is lowered into abutment against the base by means of the operating device 53, see FIG. 3*a*. The abutment device 55 is driven down so as to take over a considerable part of the weight of the load carrier 3 from the crossbar 9. The feeder 28 then continues to drive out the end of the load carrier 3. During this movement, the supporting wheels 65, 66 roll and/or, depending on the nature of the base, the sliding member, or ski, 63, slide on the base, which usually is the ground. When necessary, the feeder 28 is released from the feeding beam 43 and returned in order to engage in a new hole in the feeding beam 43. At the end of the displacement, when the feeder 28 is engaged with the feeding beam 43 in an outermost hole in the same and the crossbar 9 is on its way to leave the guideway completely, the second abutment device 56 is lowered to the ground, see FIG. 3*b*, so that the load carrier 3 can be displaced the last distance until the end of the lateral beam 13 reaches the end of the intermediate part 17. Subsequently one end of the crossbar 9 is released so that the crossbar 9 can be pivoted away and an unloading and loading ramp 69 is lowered, see FIG. 3*c*. It would otherwise be in the way of the vehicle that is to drive on to/off the load carrier 3, see FIG. 3*d*. When the load carrier 3 is to be returned to the transport position, the above-described operations are performed in reverse order.

An embodiment of the railway wagon according to the invention has been described above but should not be considered limitative. Many modifications are feasible within the scope of the invention as defined by the claims. A few examples of such modifications will be given below.

Some alternative embodiments of the abutment device are illustrated highly schematically in FIGS. 9*a*, 9*b*, 10-13. Thus the abutment device has in one variant a supporting wheel 71 which projects through an opening 73 in the sliding member 75. In another variant, it has two juxtaposed sliding members 81, 83 which cooperate each with a supporting wheel 85 and 87 respectively. In yet another variant of the abutment device, the supporting wheel 101 is vertically adjustable. In other words, the supporting wheel 101 can be set at different levels so as to project more or less, or not at all, through the opening in the sliding member 103. In another alternative embodiment, see FIG. 11, the opening in the sliding member 111 is provided by the sliding member being divided into two separate portions 113, 115 between which the supporting wheel 117 is arranged. In its very simplest design, the abutment device comprises only the sliding member and the attachment therefor, while there is no supporting wheel. However, it is a considerable advantage to have also supporting wheels which significantly reduce the friction on hard bases. In another variant, the supporting device comprises a drive unit, such as a hydraulic engine or some other drive source, which drives the supporting wheel, or the respective supporting wheels directly. The drive unit can be used to perform on its own the displacement of the load carrier, but can also be used as an auxiliary drive unit for the displacing driving device.

Figure 6:
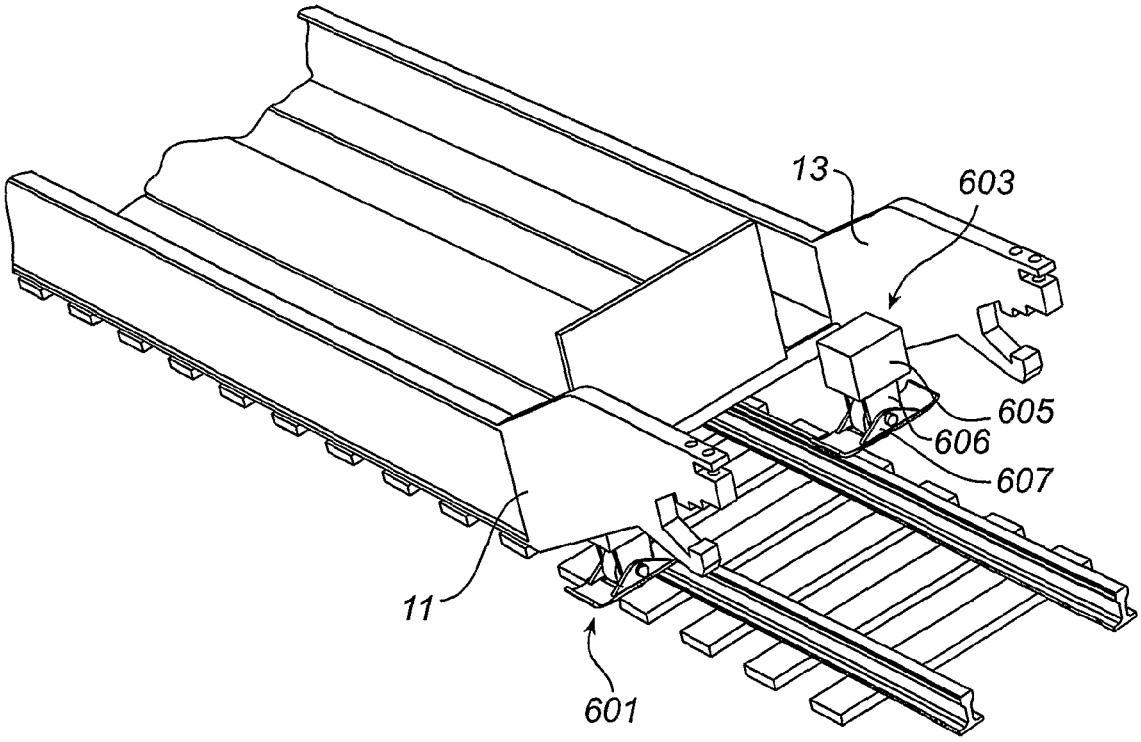
Figure 8:
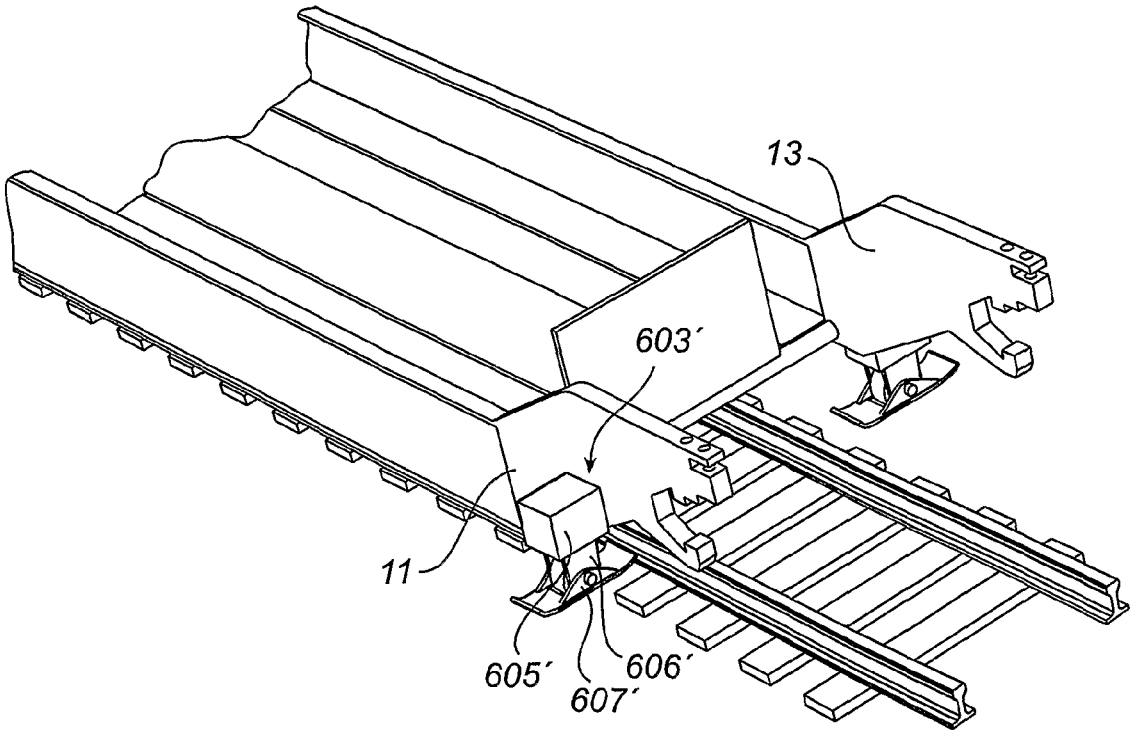

Moreover, many modifications of the supporting device as a whole are conceivable. An alternative embodiment thereof is illustrated in FIG. 6. In this embodiment, there are no operating arms. The abutment device 607 is instead directly mounted on a part of the operating device 605, 606. The entire supporting device 601 and 603, respectively, is arranged on the inside of the lateral beam 11, 13. The operating device consists of a piston-and-cylinder assembly 605, 606. The abutment device 607 is connected to the piston 606. FIG. 8 illustrates an alternative where the supporting device 603' is mounted on the outside of the lateral beam.

The devices that are shown in the examples above as piston-and-cylinder assemblies can be formed by other techniques that afford the corresponding function.

The displacement of the load carrier can be performed in various ways, for example by a chain feeder, a screw feeder etc.

Furthermore the tilt-preventing device consists in an alternative embodiment of props 36 which are arranged on each side of the respective intermediate parts 17. For the sake of simplicity, one of the props is shown in FIG. 4, although this primarily illustrates another embodiment of the railway wagon with the above-described variant of the tilt-preventing device. However, there is nothing to prevent a combination of these as illustrated in FIG. 4, thereby achieving a still more reliable construction. The prop 36 is connected to the frame side member 23 and is to be extended to allow its free end to come into abutment against the base.

In an alternative embodiment, the crossbar is omitted. The end of the lateral beam moving over the intermediate part then slides on the guideway. The end can be provided with a roll which rolls on the guideway. In a return operation, the embodiment involving the crossbar has, however, the advantage that the crossbar guides the end of the outer lateral beam upwards if it should be positioned under the connecting projection of the frame side member. To prevent this situation, it would be conceivable to arrange an automatic level control of the supporting device.

The invention claimed is:

1. A railway wagon comprising a load carrier and front and rear bogies, the load carrier being releasably connected to the respective bogies, and laterally displaceable in relation to the respective bogies, the load carrier having a front and a rear end and being at each end provided with a supporting device, which supports the load carrier in a position where it is displaced in relation to the bogie, each supporting device comprising an abutment device which is vertically operable between a pulled-up position and an extended position, in which the abutment device abuts against a base, wherein the railway wagon further comprises, at each end of the load carrier, a displacing driving device for displacing the load carrier relative to the bogie, at least along an initial displacement distance, and a tilt-preventing device, which is adapted to counteract, at least during part of the displacement, tilting tendencies of the load carrier, and each abutment device comprises a sliding member, which is adapted to abut against the base in the extended position, wherein each abutment device further comprises a supporting wheel, a portion of the supporting wheel at least in the extended position extending below an underside of the sliding member.

2. A railway wagon as claimed in claim 1, wherein the abutment device further comprises a supporting wheel which is displaceable relative to the sliding member, between a position in which a portion of the supporting wheel in the extended position extends below an underside of the sliding member and a position in which the entire supporting wheel is positioned above said underside in the extended position.

3. A railway wagon as claimed in claim 1 or 2, wherein the sliding member is formed with an opening to be passed by said portion of the supporting wheel.

4. A railway wagon as claimed in claim 1, wherein the abutment device comprises a plurality of supporting wheels.

5. A railway wagon as claimed in claim 1, wherein the sliding member is ski-shaped.

6. A railway wagon as claimed in claim 1, wherein the abutment device comprises a plurality of sliding members which are arranged side by side.

7. A railway wagon as claimed in claim 1, wherein the supporting device comprises an operating device, to which the abutment device is connected to be operated.

8. A railway wagon as claimed in claim 7, wherein the load carrier comprises a lateral beam to which the operating device is connected.

9. A railway wagon as claimed claim 8, wherein the entire supporting device is attached to the lateral beam.

10. A railway wagon as claimed in claim 9, wherein the abutment device is directly mounted on a vertically movable part of the operating device.

11. A railway wagon as claimed in claim 1, wherein two supporting devices are arranged at each end of the load carrier.

12. A railway wagon comprising a load carrier and front and rear bogies, the load carrier being releasably connected to the respective bogies, and laterally displaceable in relation to the respective bogies, the load carrier having a front and a rear end and being at each end provided with a supporting device, which supports the load carrier in a position where it is displaced in relation to the bogie, each supporting device comprising an abutment device which is vertically operable between a pulled-up position and an extended position, in which the abutment device abuts against a base, wherein the railway wagon further comprises, at each end of the load carrier, a displacing driving device for displacing the load carrier relative to the bogie, at least alone an initial displacement distance, and a tilt-preventing device, which is adapted to counteract, at least during part of the displacement, tilting tendencies of the load carrier, and each abutment device comprises a sliding member, which is adapted to abut against the base in the extended position, wherein the supporting device comprises an operating device, to which the abutment device is connected to be operated, wherein the load carrier comprises a lateral beam to which the operating device is connected, and wherein the supporting device further comprises an operating arm to one end of which the operating device is connected, for operation of the same, and the other end of which is rotatably mounted in a fastening portion of the load carrier, the operating arm having an extent in the lateral direction of the load carrier and the abutment device being connected to the operating arm between the ends thereof.

13. A railway wagon comprising a load carrier and front and rear bogies, the load carrier being releasably connected to the respective bogies, and laterally displaceable in relation to the respective bogies, the load carrier having a front and a rear end and being at each end provided with a supporting device, which supports the load carrier in a position where it is displaced in relation to the bogie, each supporting device comprising an abutment device which is vertically operable between a pulled-up position and an extended position, in which the abutment device abuts against a base, wherein the railway wagon further comprises, at each end of the load carrier, a displacing driving device for displacing the load carrier relative to the bogie, at least along an initial displacement distance, and a tilt-preventing device, which is adapted to counteract at least during part of the displacement, tilting tendencies of the load carrier, and each abutment device comprises a sliding member, which is adapted to abut against the base in the extended position, wherein the load carrier has lateral beams, which are arranged on opposite sides of the load carrier, and each tilt-preventing device comprises a crossbar which extends between the lateral beams at the ends thereof and which is movably and releasably connected to the bogie via a connecting portion, the crossbar being adapted to rest against the connecting portion at least along the initial displacement distance.

* * * * *